US006331216B1

(12) United States Patent
Toyooka et al.

(10) Patent No.: US 6,331,216 B1
(45) Date of Patent: Dec. 18, 2001

(54) STEEL PIPE HAVING HIGH DUCTILITY AND HIGH STRENGTH AND PROCESS FOR PRODUCTION THEREOF

(75) Inventors: Takaaki Toyooka; Akira Yorifuji; Masanori Nishimori; Motoaki Itadani; Yuji Hashimoto; Takatoshi Okabe; Nobuki Tanaka; Taro Kanayama, all of Aichi; Osamu Furukimi, Chiba; Masahiko Morita, Okayama; Takaaki Hira, Chiba; Saiji Matsuoka, Okayama, all of (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/214,226

(22) PCT Filed: Apr. 27, 1998

(86) PCT No.: PCT/JP98/01924

§ 371 Date: Dec. 30, 1998

§ 102(e) Date: Dec. 30, 1998

(87) PCT Pub. No.: WO98/49362

PCT Pub. Date: Nov. 5, 1998

(30) Foreign Application Priority Data

| | | |
|---|---|---|
| Apr. 30, 1997 | (JP) | 9-112247 |
| May 15, 1997 | (JP) | 9-125206 |
| Jul. 22, 1997 | (JP) | 9-196038 |
| Aug. 25, 1997 | (JP) | 9-228579 |

(51) Int. Cl.[7] ..... C21D 7/13; C22C 38/04
(52) U.S. Cl. ..... 148/320; 148/593
(58) Field of Search ..... 148/593, 320

(56) References Cited

U.S. PATENT DOCUMENTS

| | | | | |
|---|---|---|---|---|
| 4,466,842 | * | 8/1984 | Yada et al. | 148/320 |
| 5,755,895 | * | 5/1998 | Tamehiro et al. | 148/909 |

* cited by examiner

*Primary Examiner*—Deborah Yee
(74) *Attorney, Agent, or Firm*—Young & Thompson

(57) ABSTRACT

The steel pipe has a structure composed mainly of ferrite or ferrite plus pearlite or ferrite plus cementite. The steel pipe is characterized by grain size not greater than 3 μm, preferably not greater than 1 μm, elongation greater than 20%, tensile strength (TS:MPa) and elongation (E1:%) whose product is greater than 10000, and percent ductile fracture greater than 95%, preferably 100%, measured by Charpy impact test on an actual pipe at −100° C. The structure is characterized by C: 0.005–0.03%, Si: 0.01–3.0%, Mn: 0.01–2.0%, and Al: 0.001–0.10% on a weight basis, and is composed of ferrite or ferrite and a secondary phase, with ferrite grains being not greater than 3 μm and the secondary phase having an areal ratio not more than 30%. A steel pipe stock having the above-mentioned composition is heated at a temperature of ($Ac_1$+50° C.) to 400° C. and subsequently reduced at a rolling temperature of ($Ac_1$+50° C.) to 400° C. such that the cumulative reduction of diameter is greater than 20%. The reducing is preferably performed such that at least one of rolling passes reduces the diameter by more than 6% per pass. The steel pipe will have high ductility and high strength and will be superior in toughness and stress corrosion cracking resistance, if the content of C, Si, Mn, and other alloying elements is limited low and reducing is performed at the temperature specified above. The resulting steel pipe has good fatigue resistance and is suitable for use as line pipe.

20 Claims, 3 Drawing Sheets

STEEL PIPE HAVING HIGH DUCTILITY AND HIGH STRENGTH AND PROCESS FOR PRODUCTION THEREOF

This application is a 371 of PC/JP98/01924 filed Apr. 27, 1998.

1. Technical Field

The present invention relates to a steel product which has high strength and high ductility and is superior in toughness and resistance to collision and impact, particularly a steel product, such as steel pipe, wire rod, steel bar, steel section, steel plate, and steel strip, having fine crystal grains, and also to a process for production thereof.

2. Background Art

Common practice to increase the strength of a steel product is to add an alloying element such as Mn and Si, to perform heat treatment such as controlled rolling, controlled cooling, quenching, and tempering, and to add a precipitation hardening element such as Nb and V. However, what is required of steel products is not only high strength but also high ductility and high toughness. There has been a demand for a steel product which has well-balanced strength and ductility/toughness.

Making grains finer is one of a few important means to improve both strength and ductility/toughness. This is accomplished by performing austenite-ferrite transformation from fine austenite while preventing austenite grains from becoming coarse, thereby giving fine ferrite grains, by working which makes austenite grains finer, thereby giving fine ferrite grains, or by utilizing martensite and lower bainite that result from quenching and tempering.

One of these methods in general use for steel production is controlled rolling which consists of strengthening in the austenite region and its ensuing austenite-ferrite transformation to give rise to fine ferrite grains. Another way in practice is to add a trace amount of Nb which suppresses the recrystallization of austenite grains, thereby yielding finer ferrite grains. Working at a temperature at which austenite does not yet recrystallize permits austenite grains to grow, giving rise to the deformation zone in grains, and finer ferrite grains occur from this deformation zone. A recent practice to obtain finer ferrite grains is controlled cooling that is carried out during or after working.

The above-mentioned methods, however, need rebuilding of the existing facilities and considerable remodeling of the current process in the production of steel products, such as steel pipes, having improved collision and impact resistance required for better automotive safety, an ever increasing demand. Therefore, they are economically unfeasible.

In the meantime, steel products for line pipe need resistance to stress corrosion cracking by sulfides, and this object is achieved by hardness control through the reduction of impurities or the adjustment of alloying elements. In addition, conventional practices to improve fatigue resistance include heat treatment, such as thermal refining, induction hardening, and carburizing, and addition of a large amount of expensive alloying elements such as Ni, Cr, and Mo. The disadvantage of these methods is poor weldability and high production cost.

Steel pipes of small to medium diameter are produced mainly by electric resistance welding with high frequency current. The process for their production consists of continuously feeding a flat strip steel, making it into a pipe stock using a forming roll, heating the opposing edges of the pipe stock to a temperature above the melting point of steel by means of high frequency current, and butt-welding the heated edges by means of squeeze rolls.

This process, however, has a disadvantage of requiring rolls that conform to the dimensions of the desired steel pipe; therefore, it is not suitable for multi-product production in small lots.

In order to address this problem, there has been proposed a new process in, for example, Japanese Patent Publication No. 24606/1990. This process consists of heating a flat strip steel in a preheating furnace and a heating furnace, making the strip steel into a pipe by electric resistance welding, heating the pipe to a temperature above the $A_3$ transformation point, and rolling the heated pipe by a reducing mill so that it has a predetermined outside diameter.

This process, however, poses problems due to heating above $A_3$ point. Heating gives rise to scale which is bitten during rolling. Heating also makes crystal grains coarse, aggravating the ductility, strength, and toughness of the resulting steel pipe.

A cold sizing process has been proposed in Japanese Patent Laid-open No. 33105/1988. This process is designed to reduce the outside diameter of a hollow pipe stock, such as seamless steel pipes and electric welded pipes, in the cold state by using a series of reducing mills, each consisting of three rolls. The disadvantage of this process is the necessity of a large-scale mill to withstand high loads due to cold rolling and the necessity of a lubricating facility to prevent rolls from seizing. In addition, cold rolling gives rise to working strain, which aggravates ductility and toughness.

It is an object of the present invention, which was completed to address the above-mentioned problems, to provide a steel product and a process for production thereof, said steel product being superior in ductility, strength, toughness, and resistance to collision and impact owing to fine ferrite crystal grains.

DISCLOSURE OF THE INVENTION

The present inventors carried out extensive studies on a process for efficient production of high-strength steel pipes superior in ductility, which led to the finding that it is possible to produce desired steel pipes with balanced ductility and strength by reducing steel pipes of specific composition at a temperature of ferrite recrystallization.

The present invention is based on the experimental results explained below.

The experiment was carried out on electric welded steel pipes (42.7 mm in dia. and 2.9 mm thick) containing 0.09 wt % C, 0.40 wt % Si, 0.80 wt % Mn, and 0.04 wt % Al. After heating at various temperatures ranging from 750 to 400° C., they were passed through a reducing mill at a rolling speed of 200 m/min so that their outside diameter was reduced variously to 33.2–15.0 mm. The rolled pipes were tested for tensile strength (TS) and elongation (El). The relation between elongation and tensile strength is shown in FIG. 1 (black dots). Incidentally, white dots in FIG. 1 represent the relation between elongation and tensile strength of electric welded pipes in various sizes without reducing. Elongation (El) is expressed in terms of values calculated from $$El=El_0\times(\sqrt{(a_0/a)})0.4$$

(where $El_0$ is the actually measured elongation, $a_0$ is 292 $mm^2$, and a is the sectional area ($mm^2$) of the specimen.) This converted value was used in consideration of the size effect of the specimen.

It is noted from FIG. 1 that the specimens obtained by reducing after heating at 750–400° C. exhibit higher elongation for the same strength than electric welded pipes without reducing. In other words, the present inventors found that it is possible to produce high-strength steel pipes with balanced ductility and strength by reducing steel pipes of specific composition at a temperature ranging from 750° C. to 400° C.

Moreover, it was found that the above-mentioned steel pipe has fine ferrite grains not greater than 3 μm,. In order to examine resistance to collision and impact, the present inventors established the relation between tensile strength (TS) and ferrite grain size, with the strain rate greatly changed over a broad range (2000 $s^{-1}$). The results are shown in FIG. 2. It is noted from FIG. 2 that the tensile strength remarkably increases with the decreasing ferrite grain size not more than 3 μm, preferably not more than 1 μm, and this tendency is significant in the case of high strain rate as is experienced in deformation by collision and impact. In other words, it was found that steel pipes with fine ferrite grains are superior in ductile-strength balance and have greatly improved resistance to collision and impact.

The present invention is based on the above-mentioned findings.

The present invention covers a steel product with high ductility and high strength which is characterized in that it has an average grain size lower than 3 μm, preferably lower than 1 μm, in the cross section perpendicular to its lengthwise direction, that it has a structure composed mainly of ferrite or ferrite plus pearlite or ferrite plus cementite, and that it has an elongation 20% or more and a product of tensile strength (TS in MPa) and elongation (El in %) which is 10000 or more.

The present invention also covers a steel pipe with high ductility and high strength which is characterized in that it has an average grain size lower than 3 μm, preferably lower than 1 μm, in the cross section perpendicular to its lengthwise direction, that it has a structure composed mainly of ferrite or ferrite plus pearlite or ferrite plus cementite, that it has an elongation greater than 20% and a product of tensile strength (TS in MPa) and elongation (El in %) which is 10000 or more, and that it has a percent ductile fracture by Charpy impact test of 95% or more, preferably 100%, in the cross section perpendicular to its lengthwise direction.

The present invention also covers a process for producing a steel product, preferably a steel pipe, with high ductility and high strength, said process comprising rolling a steel product containing C not more than 0.60 wt % at a temperature for ferrite recrystallization with a reduction of area greater than 20%. Said rolling may be carried out by the aid of lubrication.

The present invention also covers a steel pipe with high ductility and high strength characterized in that it has a composition of C 0.005–0.30%, Si 0.01–3.0%, Mn 0.01–2.0%, Al 0.001–0.10% on a weight basis, with the remainder being Fe and unavoidable impurities, and that it has a structure of ferrite or a structure of ferrite and a second phase other than ferrite not more than 30% in terms of areal ratio, with said ferrite having a grain size not greater than 3 μm, preferably not greater than 1 μm.

In the present invention, the above-mentioned composition may be C 0.005–0.30%, Si 0.01–3.0%, Mn 0.01–2.0%, Al 0.001–0.10%, and one or more selected from Cu not more than 1%, Ni not more than 2%, Cr not more than 2%, and Mo not more than 1%, with the remainder being Fe and unavoidable impurities;

the above-mentioned composition may be C 0.005–0.30%, Si 0.01–3.0%, Mn 0.01–2.0%, Al 0.001–0.10%, and one or more selected from Nb not more than 0.1%, V not more than 0.3%, Ti not more than 0.2%, and B n not more than 0.004%, with the remainder being Fe and unavoidable impurities;

or the above-mentioned composition may be C 0.005–0.30%, Si 0.01–3.0%, Mn 0.01–2.0%, Al 0.001–0.10%, and one or more selected from REM not more than 0.02% and Ca not more than 0.01%, with the remainder being Fe and unavoidable impurities.

The above-mentioned composition may be C 0.005–0.30%, Si 0.01–3.0%, Mn 0.01–2.0%, Al 0.001–0.10%, and one or more selected from Cu not more than 1%, Ni not more than 2%, Cr not more than 2%, and Mo not more than 1% and one or more selected from Nb not more than 0.1%, V not more than 0.3%, Ti not more than 0.2%, and B not more than 0.004%.

The above-mentioned composition may be C 0.005–0.30%, Si 0.01–3.0%, Mn 0.01–2.0%, Al 0.001–0.10%, and one or more selected from Cu not more than 1%, Ni not more than 2%, Cr not more than 2%, and Mo not more than 1% ,and one or more selected from REM not more than 0.02% and Ca not more than 0.01%, with the remainder being Fe and unavoidable impurities.

The above-mentioned composition may be C 0.005–0.30%, Si 0.01–3.0%, Mn 0.01–2.0%, Al 0.001–0.10%,and one or more selected from Nb not more than 0.1%, V not more than 0.3%, Ti not more than 0.2%, and B not more than 0.004%, and one or more selected from REM not more than 0.02% and Ca not more than 0.01%, with the remainder being Fe and unavoidable impurities.

Moreover, the above-mentioned composition may be C 0.005–0.30%, Si 0.01–3.0%, Mn 0.01–2.0%, Al 0.001–0.10%, one or more selected from Cu not more than 1%, Ni not more than 2%, Cr not more than 2%, and Mo not more than 1%, one or more selected from Nb not more than 0.1%, V not more than 0.3%, Ti not more than 0.2%, and B not more than 0.004%; and one or more selected from REM not more than 0.02% and Ca not more than 0.01%, with the remainder being Fe and unavoidable impurities.

The present invention also covers a process for producing a steel pipe with high ductility and high strength, said process comprising heating a pipe stock having any of the above-mentioned compositions at ($Ac_1$+50° C.) to 400° C., preferably 750–400° C., and reducing the heated pipe stock at ($Ac_1$+50° C.) to 400° C., preferably 750–400° C., such that the cumulative diameter reduction is 20% or more. The rolling is preferably carried out such that at least one pass reduces the diameter by 6% or more per pass and the cumulative diameter reduction is 60% or more. In addition, the reducing mentioned above is preferably carried out by the aid of lubrication.

The present inventors also found that the above-mentioned process permits the production of a steel pipe with high strength and high toughness and superior resistance to stress corrosion cracking if the composition of the pipe stock is specified in an adequate range. This finding led the present inventors to conceive to utilize the process for the production of line pipes.

Line pipes conventionally have the content of impurities, such as S, reduced and the hardness controlled by means of alloying elements for improvement in resistance to stress corrosion cracking. Such conventional methods are limited in strengthening and pose a problem with high production cost. Specifying the composition of the pipe stock in an adequate range and performing the reduction in the ferrite recrystallizing region yield a line pipe with high strength and high toughness, owing to dispersed fine ferrite and fine carbide, superior in resistance to stress corrosion cracking resistance due to limited alloying elements, leading to reduced hardening by welding and less crack generation and propagation.

Accordingly, the present invention covers a process for producing a steel pipe superior in ductility and resistance to collision and impact as well as resistance to stress corrosion cracking resistance, said process comprising heating a pipe stock at ($Ac_1$+50° C.) to 400° C., preferably 750–400° C., and reducing the heated pipe stock at ($Ac_1$+50° C.) to 400° C., preferably 750–400° C., such that the cumulative diameter reduction is 20% or more, said pipe stock having a composition of C 0.005–0.10%, Si 0.01–0.5%, Mn 0.01–1.8%, Al 0.001–0.10%, one or more selected from Cu not more than 0.5%, Ni not more than 0.6%, Cr not more than 0.5%, and Mo not more than 0.5%, and one or more selected from Nb not more than 0.1%, V not more than 0.1%, Ti not more than 0.1%, and B not more than 0.004%, or further one or more selected from REM not more than 0.02% and Ca not more than 0.01%, with the remainder being Fe and unavoidable impurities.

The present inventors also found that the above-mentioned process permits the production of a steel pipe with high strength and high toughness and superior fatigue resistance if the composition of the pipe stock is specified in an adequate range. This finding led the present inventors to conceive to utilize the process for the production of steel pipes with high fatigue resistance. Specifying the composition of the pipe stock in an adequate range and performing the reduction in the ferrite recrystallizing region yield a steel pipe with high strength and high toughness, owing to dispersed fine ferrite and fine precipitation, superior in fatigue resistance due to limited alloying elements, leading to reduced hardening by welding and less crack generation and propagation.

Accordingly, the present invention covers a process for producing a steel pipe superior in ductility and strength as well as fatigue resistance, said process comprising heating a pipe stock at ($Ac_1$+50° C.) to 400° C., preferably 750–400° C., and reducing the heated pipe stock at ($Ac_1$+50° C.) to 400° C., preferably 750–400° C., such that the cumulative diameter reduction is 20% or more, said pipe stock having a composition of C 0.06–0.30%, Si 0.01–1.5%,Mn 0.01–2.0%, and Al 0.001–0.10%, with the remainder being Fe and unavoidable impurities.

In the present invention, the above-mentioned composition may be C 0.06–0.30%, Si 0.01–1.5%, Mn 0.01–2.0%,Al 0.001–0.10%, and one or more selected from Cu not more than 1.0%, Ni not more than 2.0%, Cr not more than 2.0%, and Mo not more than 1.0%, with the remainder being Fe and unavoidable impurities; the above-mentioned composition may be C 0.06–0.30%, Si 0.01–1.5%, Mn 0.01–2.0%, Al 0.001–0.10%, and one or more selected from Nb not more than 0.1%, V not more than 0.3%, Ti not more than 0.2%, and B not more than 0.004%, with the remainder being Fe and unavoidable impurities; or the above-mentioned composition may be C 0.06–0.30%, Si 0.01–1.5%, Mn 0.01–2.0%, Al 0.001–0.10%, and one or more selected from REM not more than 0.02% and Ca not more than 0.01%, with the remainder being Fe and unavoidable impurities; the above-mentioned composition may be C 0.06–0.30%, Si 0.01–1.5%, Mn 0.01–2.0%, Al 0.001–0.10%, one or more selected from Cu not more than 1.0%, Ni not more than 2.0%, Cr not more than 2.0%, and Mo not more than 1.0%, and one or more selected from Nb not more than 0.1%, V not more than 0.3%, Ti not more than 0.2%, and B not more than 0.004%, with the remainder being Fe and unavoidable impurities; the above-mentioned composition may be C 0.06–0.30%, Si 0.01–3.0%, Mn 0.01–2.0%, Al 0.001–0.10%, one or more selected from Nb not more than 0.1%, V not more than 0.3%, Ti not more than 0.2%, and B not more than 0.004%, and one or more selected from REM not more than 0.02% and Ca not more than 0.01%, with the remainder being Fe and unavoidable impurities; the above-mentioned composition may be C 0.06–0.30%, Si 0.01–1.5%, Mn 0.01–2.0%, Al 0.001–0.10%, one or more selected from Cu not more than 1.0%, Ni not more than 2.0%, and Mo not more than 1.0%, Mo not more than 1.0%, and one or more selected from REM not more than 0.02% and Ca not more than 0.01%, with the remainder being Fe and unavoidable impurities, or the above-mentioned composition may be C 0.06–0.30%, Si 0.01–1.5%, Mn 0.01–2.0%, Al 0.001–0.10%, one or more selected from Cu not more than 1.0%, Ni not more than 2.0%, Cr not more than 2.0%, and Mo not more than 1.0%, one or more selected from Nb not more than 0.1%, V not more than 0.3%, Ti not more than 0.2%, and B not more than 0.004%, and one or more selected from REM not more than 0.02% and Ca not more than 0.01%, with the remainder being Fe and unavoidable impurities.

BEST MODE FOR CARRYING OUT THE INVENTION

The following explanation shows the process of producing steel products according to the present invention.

The steel product of the present invention has a structure composed mainly of ferrite or ferrite plus pearlite or ferrite plus cementite; therefore, it is not specifically restricted in its chemical composition so long as it has the structure mentioned above. A preferred composition to give the structure of ferrite or ferrite plus pearlite or ferrite plus cementite is one which contains C not more than 0.60 wt %, preferably not more than 0.20 wt %, more preferably not more than 0.10 wt %. Another preferred composition is one which contains Si not more than 2.0 wt %, Mn not more than 2.0 wt %, Al not more than 0.10 wt %, Cu not more than 1.0 wt %, Ni not more than 2.0 wt %, Cr not more than 3.0 wt %, Mo not more than 2.0 wt %, Nb not more than 0.1 wt %, V not more than 0.5 wt %, Ti not more than 0.1 wt %, and B not more than 0.005 wt %. And, the structure may contain, in addition to ferrite, pearlite, and cementite, not more than 30 vol % of bainite without restriction. Needless to say, the structure composed mainly of ferrite plus pearlite or the structure composed mainly of ferrite plus cementite may contain a small amount of cementite or pearlite, respectively.

According to the present invention, the steel product is heated to a temperature, preferably, 800° C. or lower, and then rolled into a desired shape. The heating method is not specifically restricted; however, induction heating is desirable because of its high heating speed and its ability to suppress the growth of crystal grains. The heating temperature is preferably 800° C. or lower at which crystal grains do not become coarse, so that the grain size in the raw material is kept not greater than 20 μm. This results in fine ferrite grains not greater than 3 μm, preferably not greater than 1 μm, after subsequent ferrite recrystallization. The lower limit of the heating temperature is 400° C., preferably 550° C., because with heating under 400° C., the steel product presents difficulties in rolling due to increase in deformation resistance. Consequently, the heating temperature for rolling is 400–800° C., preferably 600–700° C. Heating is carried out such that the austenitic change is 25% or less.

Figure 1:
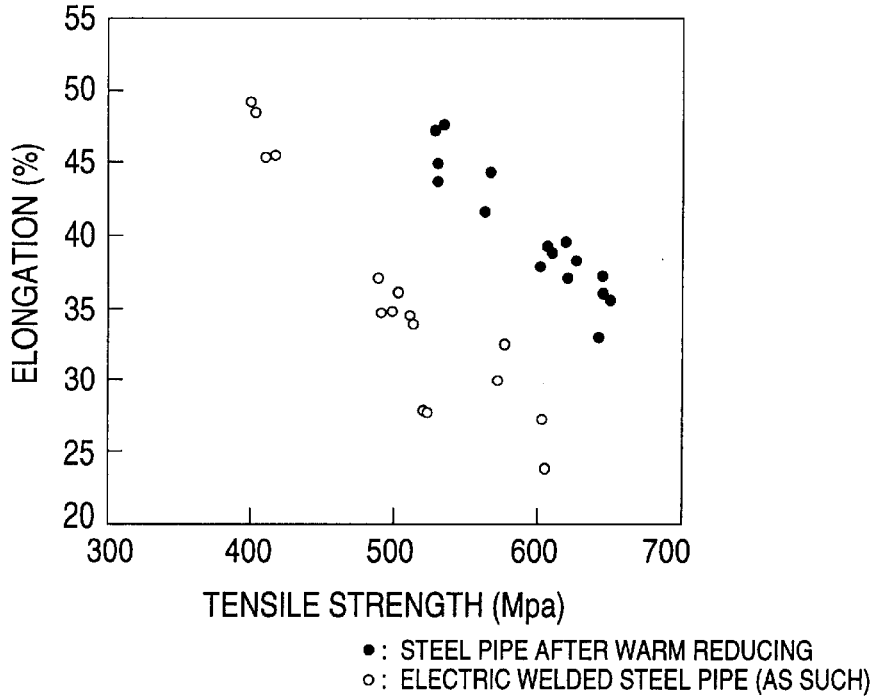
FIG. 1 is a graph showing the relation between the elongation and tensile strength of steel pipes.
Figure 2:
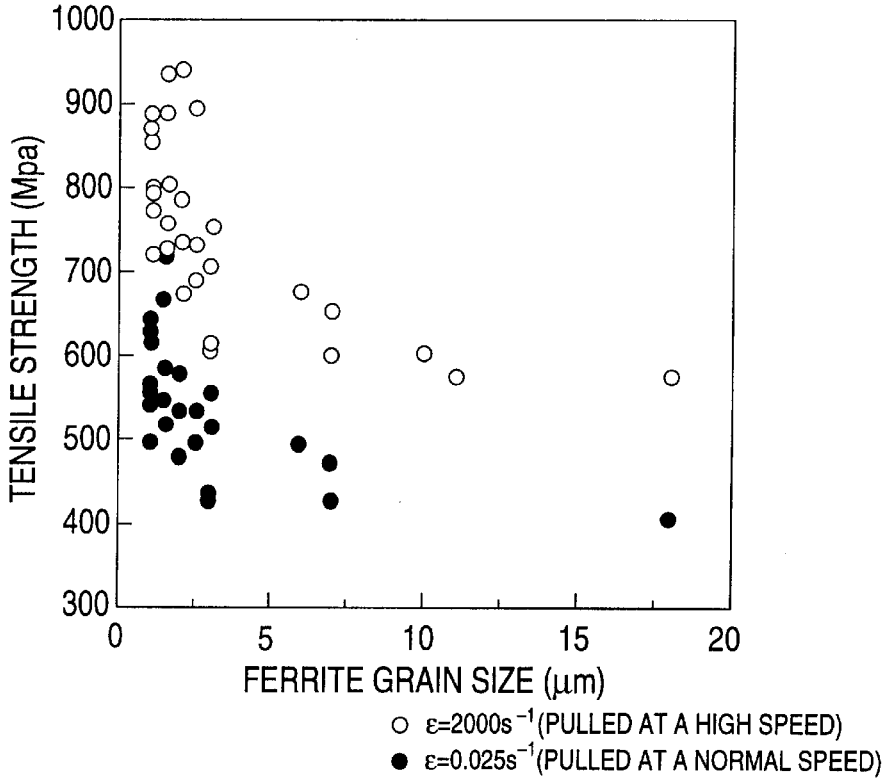
FIG. 2 is a graph showing the effect of tensile strain rate on the relation between the tensile strength and ferrite grain size of steel pipe.
Figure 3:
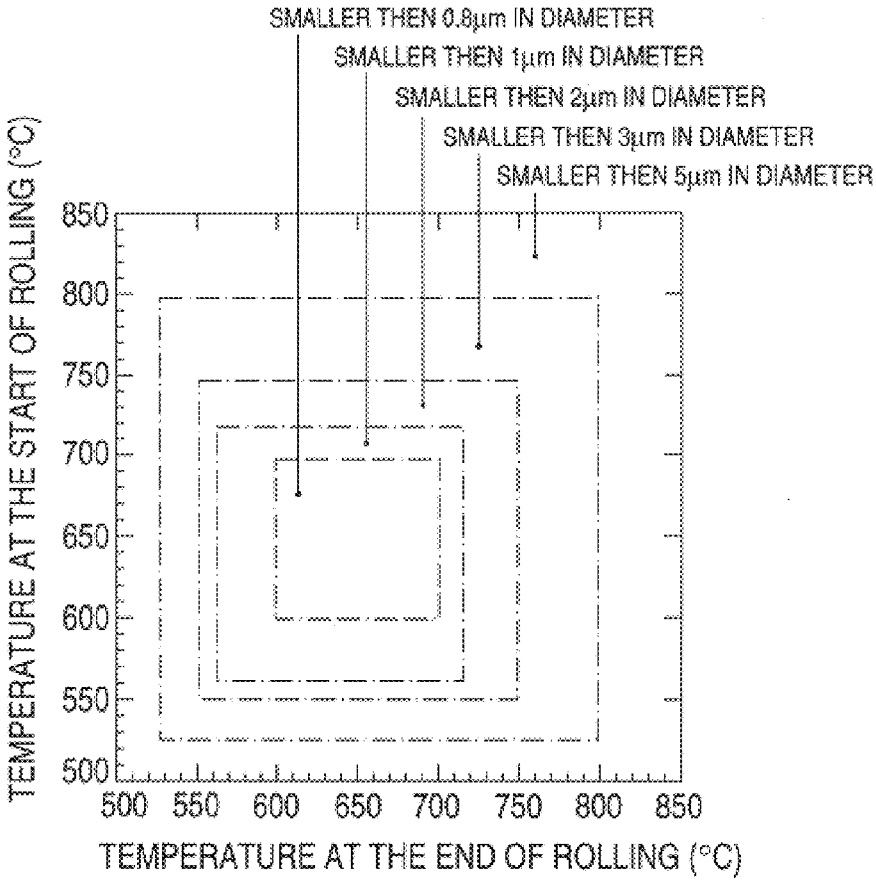
FIG. 3 is a graph showing the grain size of steel products as the function of the temperatures at which rolling starts and ends.

The rolling temperature is restricted to a range in which ferrite recrystallization takes place. In the present invention, this range is preferably 400–750° C., depending on the chemical composition of the steel blank used. Rolling at a temperature higher than this range gives rise to a two-phase structure of ferrite plus austenite containing a large amount of austenite or a single-phase structure of austenite. The resulting product does not have the structure composed mainly of ferrite or ferrite plus pearlite or ferrite plus cementite. On the other hand, rolling at a temperature exceeding 750° C. causes ferrite grains to grow remarkably after recrystallization. This is detrimental to the desired fine grains not greater than 3 μm, preferably not greater than 2 μm. Rolling at a temperature lower than 400° C. is difficult to carry out due to blue shortness, with decrease in ductility and toughness on account of insufficient recrystallization and residual deformation strain. Therefore, the rolling temperature is 400–750° C., preferably 560–720° C., more preferably 600–700° C. At 560–720° C., the grain size will be not greater than 1 μm, and at 600–700° C., the grain size will be not greater than 0.8 μm,. FIG. 3 schematically shows the relation between the grain size and the rolling temperature (at the start and end of rolling).

Rolling is carried out such that the reduction of area is greater than 20%. In the present invention, the reduction of area is defined as the value calculated by the formula $(A_0-A)/A\times100$, where $A_0$ is the cross sectional area before rolling and A is the cross sectional area after rolling. With a reduction of area less than 20%, rolling does not make recrystallized grains finer because of insufficient strain. The reduction of area is preferably greater than 50%.

After rolling, the steel product is cooled to room temperature. Cooling may be natural air cooling or any of known forced air cooling, water cooling, and mist cooling. The latter is desirable to suppress the growth of grains. The cooling rate is preferably greater than 1° C./s.

An appropriate rolling method may be selected according to the shape of the stock. For steel pipe stocks, reducing by means of a plurality of grooved rolls, called as a reducer, is desirable. Stocks adequate for this process include electric resistance welded pipes, forge-welded steel pipes, and solid phase pressure-welded steel pipes.

According to the present invention, rolling is carried out with lubrication. Lubricated rolling ensures uniform distribution of strain and grain size in the thickness direction. Rolling without lubrication tends to cause concentrated strain in the surface and uneven grain size distribution in the thickness direction. Ordinary rolling oils, such as mineral oil and synthetic ester, may be used for lubricated rolling. They are not specifically restricted.

The above-mentioned process yields a high-toughness, high-ductility steel product which has a structure composed mainly of ferrite or ferrite plus pearlite or ferrite plus cementite, and which has an average grain size not greater than 3 μm, preferably not greater than 1 μm, in the cross section perpendicular to the lengthwise direction of the steel product. The steel product of the present invention may have a structure which contains not more than 30% of bainite in addition to ferrite, pearlite, and cementite. The steel product will increase in strength but decrease in toughness and ductility if it contains bainite more than specified above and martensite.

With an average grain size in excess of 3 μm, the steel product will lose a balance between strength and toughness/ductility; that is, it does not meet the requirement that elongation is 20% or more and the product of tensile strength (TS: MPa) and elongation (El: %) is 10000 or more. A large average grain size leads to brittle cracking that occurs in the cross section in the lengthwise direction of the steel pipe during Charpy impact test at −100° C. This implies a failure to meet the requirement for toughness that the percent ductile fracture is 95% or more, preferably 100%. With an average grain size not greater than 3 μm, preferably not greater than 1 μm, the steel pipe is less vulnerable to brittle cracking in the cross section perpendicular to the lengthwise direction and is superior in toughness.

The process of the present invention for producing steel products will be described in more detail in the following, with stress placed on steel pipes.

The present invention employs steel pipes as the stock. There are no specific restrictions on the process of producing steel pipe stocks. Adequate examples include electric resistance welded steel pipes produced by electric resistance with high frequency current, solid-phase pressure-welded steel pipes produced by pressure welding after heating edges to a temperature suitable for solid-phase pressure-welding, forge-welded steel pipes, and seamless steel pipes produced by Mannesmann piercing rolling.

The following explains the reason why the chemical composition is restricted for the steel pipes as stock and product.

C: 0.005–0.30%

C is an element which dissolves in the basic metal to form a solid solution or precipitates in the form of carbide in the basic metal, thereby increasing the strength of steel. Cementite, martensite, and bainite that precipitate in the form of fine grains as the hard secondary phase contribute to ductility (uniform elongation). For the desired strength and ductility due to cementite that precipitates as the secondary phase, the content of C is 0.005% or more, preferably 0.04% or more. C in excess of 0.30% increases strength so much as to adversely affect ductility. Therefore, the content of C is limited to 0.005–0.30%, preferably 0.04–0.30%. Moreover, the content of C is not more than 0.10% for the improvement of line pipe in resistance to stress corrosion cracking. C in excess of 0.10% makes the weld zone hard, thereby adversely affecting resistance to stress corrosion cracking.

For the steel pipe to have high fatigue strength and improved fatigue resistance characteristics, the content of C is preferably 0.06–0.30%. A content less than 0.06% leads to poor fatigue resistance characteristics due to strength.

Si: 0.01–3.0%

Si is an element that functions as a deoxidizer and also forms a solid solution in the basic metal to increase the strength of steel. It produces its effect when its content is 0.01%or more, preferably 0.1% or more. With a content in excess of 3.0%, it adversely affects ductility. Therefore, the content of Si is limited to 0.01–3.0%, preferably 0.1–1.5%.

Incidentally, the content of Si is not more than 0.5% for line pipes to have improve resistance to stress corrosion cracking. Si in excess of 0.5% makes the weld zone hard, thereby adversely affecting resistance to stress corrosion cracking.

For the steel pipe to have high fatigue strength and improved fatigue resistance characteristics, the content of Si is preferably not more than 1.5%. A content in excess of 1.5% leads to poor fatigue resistance characteristics because it forms inclusions.

Mn: 0.01–2.0%

Mn is an element to increase the strength of steel. In the present invention, it also causes cementite as the secondary phase to precipitate in the form of fine grains and promotes the precipitation of martensite and bainite. With an amount less than 0.01%, it does not increase the strength, nor does it promote the precipitation of cementite, martensite, and bainite. With an amount in excess of 2.0%, it adversely affects ductility due to unduly increased excessive strength. Therefore, the amount of Mn is limited to 0.01–2.0%. From the standpoint of strength-elongation balance, it is 0.2–1.3%, preferably 0.6–1.3%.

Incidentally, the content of Mn is preferably not more than 1.8% for line pipes to have improved resistance to stress corrosion cracking. Mn in excess of 1.8% makes the weld zone hard, thereby adversely affecting resistance to stress corrosion cracking.

Al: 0.001–0.10%

Al helps form fine grains. The content of Al is at least 0.001% for desired fine grains. With a content in excess of 0.10%, it increases the amount of oxygen-based inclusions, thereby adversely affecting cleanliness. Therefore, the content of Al is limited to 0.001–0.10%, preferably 0.015–0.06%.

Furthermore, the above-mentioned composition for the steel pipe stock may contain additionally one or more of the following alloying elements.

Cu: not more than 1%, Ni: not more than 2%, Cr: not more than 2%, and Mo: not more than 1%.

These elements improve the hardenability of steel and increase the strength of steel. They may be used alone or in combination with one another according to need. They lower the transformation point and give rise to fine ferrite grains and make the secondary phase fine grains. The content of Cu is not more than 1%, preferably 0.1–0.6%, because excessive Cu adversely affects hot workability. The content of Ni is not more than 2%, preferably 0.1–1.0%, because excessive Ni is wasted without further effect of increasing strength and improving toughness. The contents of Cr and Mo are not more than 2% and 1%, respectively, preferably 0.1–1.5% and 0.05–0.5%, respectively; excessive Cr and Mo adversely affect weldability and ductility only to be wasted.

Incidentally, each of the contents of Cu, Ni, Cr, and Mo is not more than 0.5% for line pipes to have improved resistance to stress corrosion cracking. When used in excess of 0.5%, they make the weld zone hard, thereby adversely affecting resistance to stress corrosion cracking.

Nb: not more than 0.1%, V not more than 0.3%, Ti: not more than 0.2%, and B: not more than 0.004%.

These elements precipitate in the form of carbide, nitride, or carbonitride, contributing to fine grains and high strength. For steel pipes having joints heated at a high temperature, they make grains finer during heating and they also function as nuclei for ferrite precipitation during cooling, thereby preventing the weld zone from becoming hard. They may be used alone or in combination with one another according to need. When used excessively, they adversely affect weldability and toughness. Therefore, the content of Nb is not more than 0.1%, preferably 0.005–0.05%; the content of V is not more than 0.3%, preferably 0.05–0.1%; the content of Ti is not more than 0.2%, preferably 0.005–0.10%; and the content of B is not more than 0.004%, preferably 0.0005–0.002%.

Incidentally, each content of Ni, V, and Ti is not more than 0.1% for line pipes to have improved resistance to stress corrosion cracking. When used in excess of 0.1%, they adversely affecting resistance to stress corrosion cracking due to precipitation hardening.

REM: not more than 0.02% and Ca: not more than 0.01%.

Both REM and Ca adjust the form of inclusions and improve workability. They also precipitate in the form of sulfide, oxide or oxysulfide, thereby preventing the joints of steel pipe from becoming hard. They may be used alone or in combination with one another. When used excessively, they give rise to excessive inclusions, which lower cleanliness and adversely affect ductility. The content of REM is 0.004–0.02% and the content of Ca is 0.001–0.01%.

The above-mentioned composition for the steel pipe stock and steel product may additionally contain Fe as a remainder and unavoidable impurities as follows.

Unavoidable impurities are N: not more than 0.010%, O: not more than 0.006%, P: not more than 0.025%, and S: not more than 0.020%.

N: not more than 0.010%

N in an amount up to 0.010% is permissible, which is enough to form fine grains in combination with Al; however, excessive N adversely affects ductility. The content of N is not more than 0.010%, preferably 0.002–0.006%.

O: not more than 0.006%

O in an amount up to 0.006% is permissible. The content of O is as low as possible, because O forms oxides which adversely affect cleanliness.

P: not more than 0.025%

P segregates at grain boundaries, thereby adversely affecting toughness. The content of P is as low as possible, although up to 0.025% is permissible.

S: not more than 0.020%

S in an amount up to 0.020% is permissible. The content of S is as low as possible, because S forms sulfides which adversely affect cleanliness.

The following concerns the structure of the steel pipe as the product.

The steel pipe of the present invention is characterized by its structure composed of ferrite grains not larger than 3 $\mu$m, preferably not larger than 1 $\mu$m, so that it is superior in ductility and collision and impact resistance. With ferrite grains coarser than 3 $\mu$m, the steel pipe will not have remarkably improved ductility and collision and impact resistance. The ferrite grain size is expressed in terms of average value of 200 or more ferrite grains regarded as circles which are observed under an optical or electron microscope when the cross section perpendicular to the lengthwise direction of the steel pipe is corroded with nitral solution.

Figure 4:
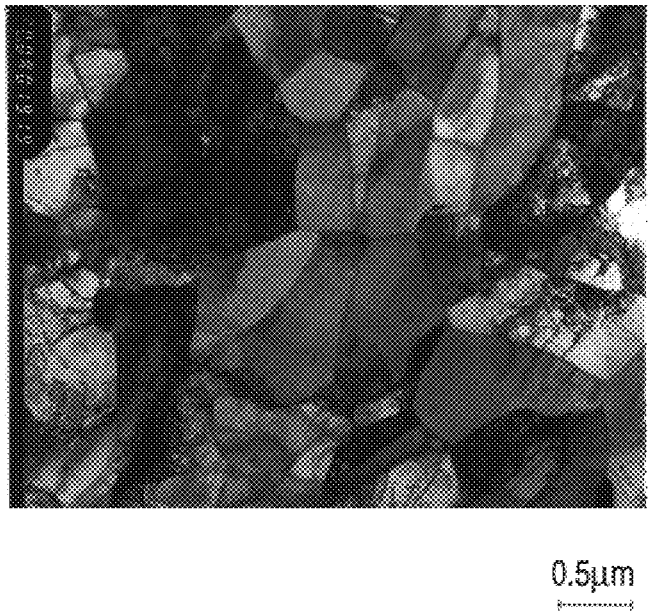
FIG. 4 is an electron photomicrograph showing the metallographic structure of a steel pipe in Example 1 of the present invention.

In the present invention, the structure composed mainly of ferrite includes the one which is composed of ferrite alone without secondary phase and the one which is composed of ferrite and a secondary phase other than ferrite. The secondary phase other than ferrite includes martensite, bainite, and cementite. They may precipitate alone or in combination with one another. The secondary phase should have a ratio of area not more than 30%. The secondary phase that has precipitated helps elongation to occur evenly at the time of deformation, thereby improving the ductility and collision and impact resistance of the steel pipe. This effect becomes less significant as its ratio of area exceeds 30%. FIG. 4 shows an example of the structure of the steel pipe of the present invention.

The following concerns the process for producing the steel pipe of the present invention.

The process starts with heating the steel pipe stock having the above-mentioned composition. The heating temperature is ($Ac_1$+50° C.) to 400° C., preferably 750–400° C. Heating beyond the upper limit deteriorates the surface properties and unduly increases austenite, resulting is coarse grains. Therefore, the heating temperature is not higher than ($Ac_1$+50° C.), preferably not higher than 750° C. Heating below the lower limit does not provide an adequate rolling temperature. Therefore, the heating temperature is preferably 400° C. or higher.

The heated steel pipe stock subsequently undergoes reducing preferably by a reducing mill of 3-roll type or 4-roll type or any other types. Continuous reducing by a plurality of stands is preferable. The number of stands depends on the dimensions of the steel pipe stock and finished steel pipe.

The rolling temperature for reducing is ($Ac_1$+50° C.) to 400° C., preferably 750–400° C., at which ferrite re-crystallization takes place. A rolling temperature beyond the upper limit causes ferrite grains to grow excessively after recrystallization, thereby decreasing ductility. Therefore, the rolling temperature is not higher than ($Ac_1$+50° C.), preferably not higher than 750° C. On the other hand, a rolling temperature below the lower limit brings about blue shortness, which leads to brittleness and fracture during rolling. A rolling temperature below 400° C. causes such troubles as increased deformation resistance, hence difficulties in rolling of material, and insufficient recrystallization, hence residual strain. Therefore, the rolling temperature for reducing is ($Ac_1$+50° C.) to 400° C., preferably 750–400° C., and more preferably 600–700° C.

Reducing is carried out such that the cumulative diameter reduction is 20% or more, which is defined by (A−B)/A× 100%, where A is the outside diameter of the base steel pipe and B is the outside diameter of the product pipe. Failing to meet this requirement results in a steel pipe poor in ductility because of insufficient action by recrystallization to make grains finer. Another problem is a low pipe forming rate and hence low productivity. In the present invention, therefore, the cumulative diameter reduction is greater than 20%. However, if it exceeds 60%, the resulting steel pipe will have high strength and high ductility which are well balanced with each other even though the content of the above-mentioned alloying elements is low, on account of work hardening, leading to increased strength, and finer structure. For this reason, the cumulative diameter reduction is preferably 60% or more.

Reducing is carried out such that at least one of rolling passes accomplishes diameter reduction 6% or more per pass. Reducing with a diameter reduction smaller than 6% per pass does not produce the effect of making crystal grains finer by recrystallization. Reducing with a diameter reduction of 6% or more per pass generates heat, hence increases temperature, keeping the desired rolling temperature. The diameter reduction per pass is preferably 8% or more for dynamic recrystallization and finer crystal grains.

The reducing of steel pipes according to the present invention provides biaxial stress, thereby producing a significant effect of making crystal grains finer. By contrast, the rolling of steel plates merely provides uniaxial stress, with free ends existing in the rolling direction as well as the widthwise direction (or the direction perpendicular to the rolling direction). Therefore, the rolling in this way is limited in ability to make grains finer.

Also, the reducing of steel pipes according to the present invention is preferably carried in the presence of a lubricant. Lubricated rolling makes even the strain distribution in the thickness direction and also makes even the grain size distribution in the thickness direction. Rolling without lubrication concentrates strain in the surface of the material due to shear effect, resulting in uneven grain size in the thickness direction. Any known rolling oil, such as mineral oil and a mixture of mineral oil and synthetic ester, may be used as a lubricant.

After reducing, the steel pipe is cooled to room temperature. Cooling may be natural air cooling or any of known forced air cooling, water cooling, and mist cooling to suppress the growth of grains. The cooling rate is preferably greater than 10° C./s.

EXAMPLE 1

A steel raw material having the chemical composition shown in Table 1 was made into flat strip steel of 3.2 mm in thickness by hot rolling. After preheating at 600° C., this strip steel was continuously formed into an open pipe by means of a plurality of forming rolls. The open pipe had its edges preheated to 1000° C. by induction heating, and the edges were heated to 1300° C. by induction heating and joined together by solid-phase pressure welding using squeeze rolls. Thus there was obtained a pipe stock, 31.8 mm in diameter and 3.2 mm in wall thickness. With its seam cooled, the pipe stock was induction-heated to temperatures shown in Table 2. The heated pipe stock was reduced by means of a 3-roll reducing mill to form a product steel pipe having the outside diameter shown in Table 2. Incidentally, lubricated rolling with a mixture of mineral oil and synthetic ester was performed on the product No. 1-2.

The product pipe thus obtained was found to have the characteristic properties, i.e., structure, grain size, tensile properties, and impact properties, as shown in Table 2. Grain size was determined by observing the cross section (C) perpendicular to the lengthwise direction of the pipe under a microscope (×5000) and expressed in terms of an average of five or more observations. Tensile properties were measured by using JIS No.11 specimens. Incidentally, elongation (El) is expressed in terms of values calculated from $$El=El_0\times(\sqrt{(a_0/a)})0.4$$

(where $El_0$ is the actually measured elongation, $a_0$ is 100 $mm^2$, and a is the sectional area ($mm^2$) of the specimen.) This converted value was used in consideration of the size effect of the specimen. Impact properties (toughness) was evaluated in terms of percent ductile fracture of cross section C at −100° C. measured in Charpy impact test with a 2-mm V notch in the lengthwise direction of the pipe.

It is noted from Table 2 that samples (Nos. 1-1 to 1-3) in examples pertaining to the present invention are characterized by a grain size of 2 μm, or fine grains not greater than 3 μm, and also by high elongation and toughness and well-balanced strength and toughness/ductility. Sample No. 1-2, which underwent lubricated rolling, shows only a little variation in grain size in the thickness direction. In contrast, sample Nos. 1-4 and 1-5 (in comparative example) are poor in ductility and toughness due to coarse grains. Incidentally, it was found that pearlite (P) includes, in addition to the lamellar structure, pseudo pearlite which does not form the lamellar structure.

EXAMPLE 2

A steel raw material having the chemical composition shown in Table 1 was made into flat strip steel of 3.2 mm in thickness by hot rolling. This strip steel was continuously formed into an open pipe by means of a plurality of forming rolls. The open pipe had its edges preheated above the melting point by induction heating, and the edges were butt-welded by using squeeze rolls. Thus there was obtained a pipe stock, 31.8 mm in diameter and 3.2 mm in wall thickness. With its bead removed by a bead cutter, the resulting electric welded pipe was heated again at the temperature shown in Table 3 by induction heating. It was reduced by means of a 3-roll reducing mill to form a finished pipe having the outside diameter shown in Table 3.

The finished pipe thus obtained was tested for characteristic properties, i.e., structure, grain size, tensile properties, and toughness, in the same manner as in Example 1. The results are shown in Table 3.

It is noted from Table 3 that samples (Nos. 2-2, 2-3, 2-5, and 2-7) in examples pertaining to the present invention are characterized by fine grains not greater than 3 $\mu$m and also by high elongation and toughness and well-balanced strength and toughness/ductility. Bycontrast, samples (Nos. 2-1, 2-4, 2-6, 2-8, and 2-9) in comparative examples are poor in ductility and toughness due to coarse grains.

EXAMPLE 3

A steel having the composition shown in Table 1 was prepared by using a converter, and this steel was made into a billet by the continuous casting process. After heating, this billet was made into a seamless pipe of 158 mm in outside diameter and 8 mm in wall thickness by using a Mannesmann mandrel mill. This seamless pipe was heated again to the temperature shown in Table 4 by induction heating and then reduced by means of a 3-roll reducing mill to form a product pipe having the outside diameter shown in Table 4.

The product pipe thus obtained was tested for characteristic properties in the same manner as in Examples 1 and 2. The results are shown in Table 4.

It is noted from Table 4 that samples (Nos. 3-1, 3-2, 3-4, and 3-5) in examples pertaining to the present invention are characterized by fine grains not greater than 3 $\mu$m and also by high elongation and toughness and well-balanced strength and toughness/ductility. By contrast, samples (Nos. 3-3 and 3-6) in comparative examples are poor in ductility and toughness due to coarse grains.

EXAMPLE 4

A base steel pipe having the chemical composition shown in Table 5 was heated by induction to a temperature shown in Table 6 and then rolled into a finished steel pipe by means of a 3-roll reducing mill under the rolling conditions shown in Table 6.

The base steel pipe in Table 6 is either solid-phase pressure-welded one or seamless one. The former was prepared by preheating a 2.6 mm thick hot-rolled strip steel to 600° C., continuously forming it into an open pipe by means of a plurality of forming rolls, preheating the edges of the open pipe to 1000° C. by induction, heating the edges to 1450° C. below the melting point by induction, and pressure-welding the edges by means of a squeeze roll. It is 42.7 mm in diameter and 2.6 mm in wall thickness. The seamless pipe was prepared by using a Mannesmann mandrel mill from a continuously cast billet (with heating).

The product pipe thus obtained was tested for tensile properties, collision and impact properties, and structure. The results are shown in Table 6. Tensile properties were measured by using JIS No.11 specimens. Incidentally, elongation (El) is expressed in terms of values calculated from $$El=El_0\times(\sqrt{(a_0/a)})0.4$$

(where $El_0$ is the actually measured elongation, $a_0$ is 292 $mm^2$, and a is the sectional area ($mm^2$) of the specimen.) This converted value was used in consideration of the size effect of the specimen. Collision and impact properties were evaluated in terms of the amount of energy which is absorbed before the amount of strain reaches 30% in the stress-strain curve obtained by the high-speed tensile test at a strain rate of 2000 $s^{-1}$. Incidentally, collision and impact properties are a measure of energy required to deform the material when an automobile actually collides at a strain rate of 1000–2000 $s^{-1}$. The larger the amount of this energy, the better the collision and impact resistance.

It is noted from Table 6 that samples (Nos. 4-1 to 4-16 and 4-19 to 4-22) in examples pertaining to the present invention have well-balanced ductility and strength, with a high tensile strength at a high strain rate and a high energy absorption at the time of collision and impact. By contrast, samples (Nos. 4-17, 4-18, and 4-23) in comparative examples are poor in either ductility or strength, poor in balance between strength and ductility, and poor in collision and impact resistance.

Comparative samples (Nos.4-17 and 4-18), which do not conform to the present invention in diameter reduction, have coarse ferrite grains, unbalanced strength-ductility, and low energy absorption at the time of collision and impact.

EXAMPLE 5

A base steel pipe having the chemical composition shown in Table 7 was heated by induction to a temperature shown in Table 8 and then rolled into a product steel pipe by means of a 3-roll reducing mill under the rolling conditions shown in Table 8. Incidentally, the steel pipe stock was prepared in the same manner as in Example 4.

The product steel pipe was tested for tensile properties, collision and impact properties, and structure in the same way as in Example 4. The results are shown in Table 8.

It is noted from Table 8 that samples (Nos. 5-1 to 5-3 and 5-7 to 5-10) in examples pertaining to the present invention have well-balanced ductility and strength, with a high tensile strength at a high strain rate and a high energy absorption at the time of collision and impact. By contrast, samples (Nos. 5-4 to 5-6) in comparative examples are poor in either ductility or strength, poor in balance between strength and ductility, and poor in collision and impact resistance.

The present invention provides a steel pipe having well-balanced ductility and strength and good collision and impact properties, unlike the conventional technology. This steel pipe is suitable for bulging by hydroforming or the like. Bulging will be very easy to perform in the case of electric welded pipe or solid-phase pressure-welded pipe with the seam cooled, because the hardened seam has the same level of hardness as the pipe stock on account of reducing.

EXAMPLE 6

A base steel pipe, 110 mm in diameter and 4.5 mm in wall thickness, having the chemical composition shown in Table 9 was produced from hot-rolled steel plate which had undergone controlled rolling and controlled cooling. The base steel pipe was heated by induction to a temperature shown in Table 10 and then reduced by using a 3-roll reducing mill under the condition shown in Table 10.

The product steel pipe was tested for tensile properties, collision and impact properties, structure, and sulfide stress corrosion cracking resistance. The results are shown in Table 10. Tensile properties were measured by using JIS No.11 specimens in the same manner as in Example 4. Incidentally, elongation (El) is expressed in terms of values calculated from $$El=El_0\times(\sqrt{(a_0/a)})0.4$$

(where $El_0$ is the actually measured elongation, $a_0$ is 292 $mm^2$, and a is the sectional area ($mm^2$) of the specimen.) This converted value was used in consideration of the size effect of the specimen.

Collision and impact properties were evaluated in terms of the amount of energy which is absorbed before the amount of strain reaches 30% in the stress-strain curve obtained by the high-speed tensile test at a strain rate of 2000 $s^{-1}$. Incidentally, collision and impact properties are a measure of energy required to deform the material when an automobile actually collides at a strain rate of 1000–2000 $s^{-1}$. The greater the amount of this energy, the better the collision and impact resistance.

Figure 5:
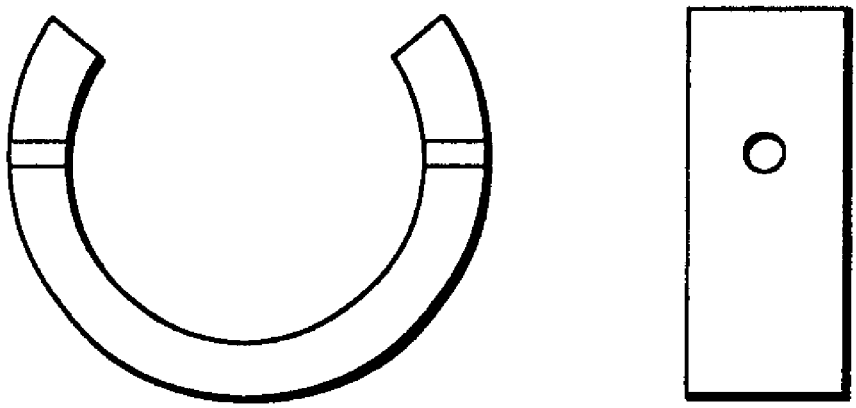
FIG. 5 is a schematic diagram showing a test piece used in test for resistance to stress corrosion cracking by sulfides.

Incidentally, the sulfide stress corrosion cracking resistance was evaluated by observing whether or not a C-ring test piece shown in FIG. 5 breaks within 200 hours when it is immersed under a tensile stress corresponding to 120% of yield strength in an NACE bath (composed of 0.5% acetic acid and 5% sodium chloride, saturated with hydrogen sulfide) at 25° C. and 1 atm. The C-ring test piece was cut out of the product pipe in its circumferential direction. This test was duplicated for each sample under the same conditions.

It is noted from Table 10 that samples (Nos. 6-1 to 6-3, 6-6, 6-8 to 6-10) in examples pertaining to the present invention have well-balanced ductility and strength, high tensile strength at high strain rate, and high energy absorption at the time of collision and impact. They are also superior in sulfide stress corrosion cracking resistance, and hence they are suitable for use as line pipes. By contrast, samples (Nos. 6-4, 6-5, and 6-7) in comparative examples are poor in either ductility or strength, poor in balance between strength and ductility, poor in collision and impact properties, and poor in sulfide stress corrosion cracking resistance as indicated by breakage in the NACE bath.

Samples (Nos. 6-4 and 6-7) in comparative examples, which were reduced at a rolling temperature outside the range specified in the present invention, are poor in balance between strength and ductility due to coarse ferrite grains, poor in energy absorption at the time of collision and impact, and poor in sulfide stress corrosion cracking resistance.

EXAMPLE 7

A base steel pipe having the chemical composition shown in Table 11 was heated by induction to a temperature shown in Table 12 and then rolled into a product steel pipe by means of a 3-roll reducing mill under the rolling conditions shown in Table 12. The base steel pipe in this example was either electric resistance welded pipe of 110 mm in diameter and 2.0 mm in wall thickness or seamless steel pipe of 110 mm in diameter and 3.0 mm in wall thickness. The former was prepared by forming an open pipe from hot-rolled strip steel by means of a plurality of forming rolls and then welding the edges by induction heating. The latter was prepared by using a Mannesmann mandrel mill from a continuously cast billet with heating.

The product pipe thus obtained was tested for tensile properties, collision and impact properties, structure, and fatigue resistance. The results are shown in Table 12. Tensile properties and collision and impact properties were measured in the same manner as in Example 4. Fatigue strength was measured by subjecting the finished pipe as a specimen to cantilever reversed fatigue test (at a repeating rate of 20 Hz) in the air.

It is noted from Table 12 that samples (Nos. 7-1, 7-3, and 7-6 to 7-8) in examples have well-balanced ductility and strength, high tensile strength at high strain rate, and high energy absorption at the time of collision and impact. In addition, they are superior in fatigue resistance. By contrast, samples (Nos. 7-2, 7-4, and 7-5) in comparative examples are poor in fatigue strength. Sample No. 7-2 did not undergo reducing, sample 7-5 had a ratio of reduction in diameter which is outside the specified range, and sample No. 7-4 was reduced at a temperature outside the specified range. Therefore, it is poor in balance between strength and ductility due to coarse ferrite grains, poor in energy absorption at the time of collision and impact, and poor in fatigue resistance.

EXPLOITATION IN INDUSTRY

The present invention provides a high-strength steel product superior in toughness and ductility on account of extremely fine grain size not greater than 3 $\mu$m. Therefore, it will produce a significant industrial effect of expanding the application area of steel products. The present invention also provides a process for efficient and easy production of high-strength steel pipe superior in ductility and impact resistance. Therefore, it will produce a significant industrial effect of expanding the application area of steel pipe. The present invention permits the production of steel pipes for line pipes which need high strength and toughness and good stress corrosion cracking resistance. The present invention also permits the economical production of high-strength, high-ductility steel pipe having good fatigue resistance, with the amount of alloying elements reduced.

TABLE 1

| Steel | Chemical composition (wt %) | | | | | | |
|---|---|---|---|---|---|---|---|
| No. | C | SI | Mn | P | S | AI | N |
| A | 0.06 | 0.05 | 0.35 | 0.018 | 0.019 | 0.028 | 0.0025 |
| B | 0.08 | 0.25 | 1.28 | 0.007 | 0.002 | 0.041 | 0.0025 |
| C | 0.25 | 0.20 | 0.82 | 0.012 | 0.007 | 0.010 | 0.0028 |
| D | 0.16 | 0.22 | 0.75 | 0.009 | 0.006 | 0.031 | 0.0033 |

TABLE 2

| | | | Rolling conditions | | | | |
|---|---|---|---|---|---|---|---|
| Sample No. | Steel No. | O.D. of base temp. pipe (mm) | Heating temp. (° C.) | Temp. at starting rolling (° C.) | Temp. at finishing rolling (° C.) | Reduction of area (%) | O.D. of product pipe (mm) |
| 1-1 | A | 31.8 | 750 | 700 | 675 | 60 | 15.0 |
| 1-2 | | | 700 | 670 | 625 | 60 | 15.0 |

TABLE 2-continued

| | | | | | | | |
|---|---|---|---|---|---|---|---|
| 1-3 | | 650 | 590 | 585 | 60 | 15.0 |
| 1-4 | | 550 | 540 | 530 | 60 | 15.0 |
| 1-5 | | | — | | | 31.8 |

| | Characteristics of product pipe | | | | | | | |
|---|---|---|---|---|---|---|---|---|
| Sample No. | Grain size (μm) | Yield point YS, (MPa) | Tensile strength TS, (MPa) | Elonga-ion El, (%) | TS × El (MPa · %) | Percent ductile fracture by Charpy (%) | Structure * | Note |
| 1-1 | 2 | 401 | 425 | 37 | 15725 | 100 | F + P + 5% B | Ex. |
| 1-2 | 2 | 428 | 452 | 36 | 16272 | 100 | F + C | Ex. |
| 1-3 | 2 | 490 | 510 | 26 | 13260 | 100 | F + P | Ex. |
| 1-4 | 10 | 593 | 603 | 19 | 11457 | 10 | F + P | C. Ex. |
| 1-5 | 17 | 307 | 338 | 29 | 9802 | 0 | F + P | C. Ex. |

* F: ferrite, P: pearlite (including pseudo pearlite), C: cementite, B: Bainite
Ex.: Example pertaining to the present invention. C. Ex.: Comparative Example

20

TABLE 3

| | | | Rolling conditions | | | | |
|---|---|---|---|---|---|---|---|
| Sample No. | Steel No. | O.D. of base temp. pipe (mm) | Heating temp. (° C.) | Temp. at starting rolling (° C.) | Temp. at finishing rolling (° C.) | Reduction of area (%) | 0.D. of product pipe (mm) |
| 2-1 | B | 31.8 | 900 | 770 | 715 | 60 | 15 |
| 2-2 | | | 800 | 770 | 715 | 60 | |
| 2-3 | | | 700 | 670 | 630 | 60 | |
| 2-4 | | | 700 | 520 | 535 | 60 | |
| 2-5 | | | 600 | 590 | 605 | 60 | |
| 2-6 | | | 520 | 500 | 520 | 60 | |
| 2-7 | | | 700 | 660 | 630 | 30 | |
| 2-8 | | | 700 | 660 | 650 | 10 | |
| 2-9 | | | | — | | | 31.8 |

| | Characteristics of product pipe | | | | | | | |
|---|---|---|---|---|---|---|---|---|
| Sample No. | Grain size (μm) | Yield point YS, (MPa) | Tensile strength TS, (MPa) | Elonga-ion El, (%) | TS × El (MPa·%) | Percent ductile fracture by Charpy (%) | Structure * | Note |
| 2-1 | 20 | 430 | 457 | 29 | 13253 | 30 | F + P + 5% B | C. Ex. |
| 2-2 | 2 | 470 | 500 | 40 | 20000 | 100 | F + C + 15% B | Ex. |
| 2-3 | 1 | 523 | 556 | 39 | 21684 | 100 | F + P + 10% B | Ex. |
| 2-4 | 6 | 619 | 658 | 13 | 8554 | 10 | F + P + 10% B | C. Ex. |
| 2-5 | 1 | 581 | 618 | 36 | 22248 | 100 | F + P + 5% B | Ex. |
| 2-6 | 6 | 620 | 660 | 14 | 9240 | 20 | F + P + 5% B | C. Ex. |
| 2-7 | 3 | 502 | 534 | 33 | 17622 | 100 | F + P + 10% B | Ex. |
| 2-8 | 9 | 435 | 468 | 30 | 14040 | 50 | F + P + 10% B | C. Ex. |
| 2-9 | 12 | 424 | 460 | 29 | 13340 | 40 | F + P + 5% B | C. Ex. |

F: ferrite, P: pearlite (including pseudo pearlite), C.: cementite, B: Bainite
Ex.: Example pertaining to the present invention. C. Ex.: Comparative Example

TABLE 4

| Sample No. | Steel No. | O.D. of base temp. pipe (mm) | Rolling conditions: Heating temp. (° C.) | Temp. at starting rolling (° C.) | Temp. at finishing rolling (° C.) | Reduction of area (%) | 0.D. of product pipe (mm) |
|---|---|---|---|---|---|---|---|
| 3-1 | C | 158 | 700 | 660 | 657 | 75 | 55.0 |
| 3-2 | | | 650 | 622 | 613 | 75 | 55.0 |
| 3-3 | | | | | — | | 158.0 |
| 3-4 | D | | 700 | 690 | 680 | 75 | 55.0 |
| 3-5 | | | 650 | 635 | 630 | 75 | 55.0 |
| 3-6 | | | | | — | | 158.0 |

| Sample No. | Characteristics of product pipe: Grain size (μm) | Yield point YS, (MPa) | Tensile strength TS, (MPa) | Elongation El, (%) | TS × El (MPa · %) | Percent ductile fracture by Charpy (%) | Structure * | Note |
|---|---|---|---|---|---|---|---|---|
| 3-1 | 3 | 579 | 658 | 23 | 15134 | 100 | F + P | Ex. |
| 3-2 | 3 | 600 | 678 | 24 | 16272 | 100 | F + P | Ex. |
| 3-3 | 21 | 401 | 555 | 18 | 9990 | 10 | F + P | C. Ex. |
| 3-4 | 1 | 500 | 547 | 32 | 17504 | 100 | F + P | Ex. |
| 3-5 | 2 | 608 | 627 | 29 | 18183 | 100 | F + P | Ex. |
| 3-6 | 9 | 426 | 501 | 27 | 13527 | 40 | F + P | C. Ex. |

* F: ferrite, P: pearlite (including pseudo pearlite), C: cementite, B: Bainite
Ex.: Example pertaining to the present invention. C. Ex.: Comparative Example

TABLE 5

| Steel No. | Chemical composition (wt %): C | Si | Mn | P | S | Al | N | O | $AC_1$ (° C.) | Note |
|---|---|---|---|---|---|---|---|---|---|---|
| E | 0.09 | 0.40 | 0.80 | 0.012 | 0.005 | 0.035 | 0.0035 | 0.0025 | 770 | Example |
| F | 0.08 | 0.07 | 1.42 | 0.015 | 0.011 | 0.036 | 0.0038 | 0.0036 | 760 | Example |
| G | 0.06 | 0.21 | 0.35 | 0.013 | 0.008 | 0.028 | 0.0025 | 0.0028 | 775 | Example |
| H | 0.11 | 0.22 | 0.45 | 0.017 | 0.013 | 0.018 | 0.0071 | 0.0035 | 775 | Example |
| I | 0.21 | 0.20 | 0.50 | 0.016 | 0.013 | 0.024 | 0.0043 | 0.0030 | 770 | Example |
| J | 0.03 | 0.05 | 0.15 | 0.021 | 0.007 | 0.041 | 0.0026 | 0.0038 | 780 | Example |
| K | 0.09 | 0.15 | 0.52 | 0.024 | 0.003 | 0.004 | 0.0025 | 0.0026 | 775 | Example |

TABLE 6 (1)

| No. | Steel No. | Base pipe: Type | O.D. (mm) | Rolling conditions: Heating temp. (° C.) | Temp. at starting rolling (° C.) | Temp. at finishing rolling (° C.) | Cumulative diameter reduction (%) | No. of total passes | No. of passes (6% and up per pass) | Final rolling speed (m/min) | O.D. of product pipe (mm) |
|---|---|---|---|---|---|---|---|---|---|---|---|
| 4-1 | E | SP-PW | 42.7 | 750 | 710 | 690 | 65 | 14 | 9 | 200 | 15.0 |
| 4-2 | E | SP-PW | 42.7 | 700 | 670 | 660 | 65 | 14 | 9 | 200 | 15.0 |
| 4-3 | E | SP-PW | 42.7 | 650 | 635 | 620 | 65 | 14 | 9 | 200 | 15.0 |
| 4-4 | E | SP-PW | 42.7 | 700 | 655 | 630 | 40 | 7 | 4 | 140 | 25.5 |
| 4-5 | E | SP-PW | 42.7 | 650 | 605 | 590 | 40 | 7 | 4 | 140 | 25.5 |
| 4-6 | E | SP-PW | 42.7 | 700 | 660 | 630 | 30 | 5 | 3 | 120 | 29.7 |
| 4-7 | E | SP-PW | 42.7 | 650 | 615 | 590 | 30 | 5 | 3 | 120 | 29.7 |
| 4-8 | E | SP-PW | 42.7 | 700 | 660 | 640 | 22 | 3 | 2 | 110 | 33.2 |

TABLE 6 (1)-continued

| | | | | Rolling conditions | | | | | | | |
|---|---|---|---|---|---|---|---|---|---|---|---|
| 4-9 | E | SP-PW | 42.7 | 650 | 615 | 585 | 22 | 3 | 2 | 110 | 33.2 |
| 4-10 | E | SP-PW | 42.7 | 650 | 620 | 580 | 22 | 7 | 0 | 110 | 33.2 |

| | Characteristics of product pipe | | | | | | | |
|---|---|---|---|---|---|---|---|---|
| No. | Tensile strength TS (MPa) | Elongation El (%) | High speed tensile strength (MPa) | Energy absorbed at collision and impact (MJ · $m^{-3}$) | Ferrite grain size (μm) | Ratio of area of secondary phase (%) | Kind of secondary phase * | Note |
| 4-1 | 525 | 44 | 728 | 242 | 2.0 | 10 | C | Ex. |
| 4-2 | 575 | 43 | 780 | 260 | 2.0 | 11 | C | Ex. |
| 4-3 | 622 | 40 | 864 | 292 | 1.0 | 11 | C | Ex. |
| 4-4 | 537 | 43 | 761 | 257 | 1.0 | 11 | C | Ex. |
| 4-5 | 580 | 38 | 799 | 267 | 1.5 | 11 | C | Ex. |
| 4-6 | 512 | 40 | 724 | 241 | 1.5 | 11 | C | Ex. |
| 4-7 | 562 | 38 | 799 | 268 | 1.0 | 11 | C | Ex. |
| 4-8 | 493 | 42 | 712 | 230 | 1.0 | 11 | C | Ex. |
| 4-9 | 541 | 39 | 755 | 249 | 1.5 | 11 | C | Ex. |
| 4-10 | 537 | 36 | 751 | 242 | 1.5 | 11 | C | Ex. |

* C: cementite, B: bainite, M: martensite, P: Pearlite
Note:
Ex.: examples pertaining to the present invention, C. Ex.: comparative examples.
SF-PW: solid-phase pressure-welded pipe

TABLE 6 (2)

| | | Base pipe | | Rolling conditions | | | | | | | |
|---|---|---|---|---|---|---|---|---|---|---|---|
| No. | Steel No. | Type | O.D. (mm) | Heating temp. (° C.) | Temp. at starting rolling (° C.) | Temp. at finishing rolling (° C.) | Cumulative diameter reduction (%) | No. of total passes | No. of passes (6% and up per pass) | Final rolling speed (m/min) | O.D. of product pipe (mm) |
| 4-11 | F | ERW | 42.7 | 650 | 650 | 622 | 65 | 14 | 9 | 200 | 15.0 |
| 4-12 | F | ERW | 42.7 | 600 | 590 | 580 | 65 | 14 | 9 | 200 | 15.0 |
| 4-13 | G | ERW | 42.7 | 650 | 640 | 620 | 65 | 14 | 9 | 200 | 15.0 |
| 4-14 | H | SP | 110 | 700 | 695 | 670 | 77 | 17 | 10 | 150 | 25.6 |
| 4-15 | I | SP | 110 | 700 | 695 | 670 | 77 | 17 | 10 | 150 | 25.6 |
| 4-16 | E | SP-PW | 42.7 | 550 | 540 | 528 | 85 | 14 | 9 | 200 | 15.0 |
| 4-17 | G | ERW | 42.7 | — | — | — | 0 | — | — | — | 42.7 |
| 4-18 | G | ERW | 42.7 | 650 | 630 | 615 | 11 | 3 | 1 | 80 | 38.0 |
| 4-19 | J | ERW | 42.7 | 650 | 600 | 545 | 65 | 14 | 9 | 200 | 15.0 |
| 4-20 | K | ERW | 42.7 | 750 | 705 | 690 | 65 | 14 | 9 | 200 | 15.0 |
| 4-21 | K | ERW | 42.7 | 650 | 620 | 615 | 65 | 14 | 9 | 200 | 15.0 |
| 4-22 | K | ERW | 42.7 | 750 | 710 | 685 | 41 | 7 | 4 | 140 | 25.3 |
| 4-23 | K | ERW | 42.7 | 950 | 910 | 890 | 22 | 3 | 2 | 110 | 33.1 |

| | Characteristics of product pipe | | | | | | | |
|---|---|---|---|---|---|---|---|---|
| No. | Tensile strength TS (MPa) | Elongation El (%) | High speed tensile strength (MPa) | Energy absorbed at collision and impact (MJ · $m^{-3}$) | Ferrite grain size (μm) | Ratio of area of secondary phase (%) | Kind of secondary phase * | Note |
| 4-11 | 555 | 42 | 792 | 265 | 1.0 | 15 | C | Ex |
| 4-12 | 611 | 37 | 850 | 289 | 1.0 | 15 | C | Ex |
| 4-13 | 492 | 42 | 685 | 225 | 2.5 | 7 | C | Ex. |
| 4-14 | 475 | 52 | 666 | 219 | 2.0 | 9 | C | Ex. |
| 4-15 | 526 | 46 | 733 | 231 | 2.0 | 22 | C + B | Ex. |
| 4-16 | 688 | 30 | 892 | 299 | 2.5 | 12 | C | Ex. |
| 4-17 | 409 | 43 | 566 | 185 | 11.0 | 6 | P | C. Ex. |
| 4-18 | 427 | 40 | 570 | 191 | 7.0 | 8 | C | C. Ex. |
| 4-19 | 552 | 29 | 744 | 248 | 3.0 | 0 | — | Ex. |
| 4-20 | 431 | 48 | 611 | 202 | 3.0 | 13 | C | Ex. |
| 4-21 | 511 | 33 | 704 | 233 | 3.0 | 13 | C | Ex. |

TABLE 6 (2)-continued

| | | | | | | | | |
|---|---|---|---|---|---|---|---|---|
| | | | | Rolling conditions | | | | |
| 4-22 | 425 | 47 | 604 | 206 | 3.0 | 12 | C | Ex. |
| 4-23 | 410 | 45 | 570 | 183 | 18.0 | 13 | C | C. Ex |

* C: cementite, B: bainite, M: martensite, P: Pearlite
Note:
Ex.: examples pertaining to the present invention, C. Ex.: comparative examples.
ERW: electric resistance welded pipe.
SP: Seamless Pipe
Sample No. 4–17 did not undergo reducing.

TABLE 7

| Steel | Chemical composition (wt %) | | | | | | | | | | | | | | | | | $AC_1$ | |
|---|---|---|---|---|---|---|---|---|---|---|---|---|---|---|---|---|---|---|---|
| No. | C | Si | Mn | P | S | Al | N | 0 | Cu | Ni | Cr | Mo | V | Nb | Ti | B | Ca | (° C.) | Note |
| L | 0.07 | 0.20 | 0.66 | 0.018 | 0.005 | 0.028 | 0.0022 | 0.0025 | — | — | — | — | — | 0.009 | 0.008 | — | — | 765 | Ex. |
| M | 0.08 | 0.04 | 1.35 | 0.015 | 0.011 | 0.036 | 0.0041 | 0.0032 | — | — | — | — | 0.10 | — | — | — | 0.002 | 755 | Ex. |
| N | 0.15 | 0.21 | 0.55 | 0.009 | 0.004 | 0.010 | 0.0028 | 0.0028 | — | — | 0.21 | 0.53 | — | — | — | — | — | 785 | Ex. |
| O | 0.05 | 1.01 | 1.35 | 0.012 | 0.001 | 0.035 | 0.0030 | 0.0030 | — | — | 0.92 | — | — | 0.015 | 0.011 | 0.0023 | — | 790 | Ex. |
| P | 0.15 | 0.22 | 0.41 | 0.018 | 0.003 | 0.031 | 0.0036 | 0.0038 | 0.11 | 0.15 | — | — | — | — | — | — | 0.002 | 760 | Ex. |

TABLE 8

| | | | | Rolling conditions | | | | | | | |
|---|---|---|---|---|---|---|---|---|---|---|---|
| | | Base pipe | | Heating | Temp. at starting | Temp. at finishing | Cumulative diameter | No. of | No. of passes (6% and | Final rolling | O.D. of product |
| No. | Steel No. | Type | O.D. (mm) | temp. (° C.) | rolling (° C.) | rolling (° C.) | reduction (%) | total passes | up per pass) | speed (m/min) | pipe (mm) |
| 5-1 | L | SP-PW | 42.7 | 730 | 700 | 640 | 65 | 14 | 9 | 200 | 15.0 |
| 5-2 | L | SP-PW | 42.7 | 670 | 640 | 600 | 65 | 14 | 9 | 200 | 15.0 |
| 5-3 | L | SP-PW | 42.7 | 620 | 600 | 560 | 65 | 14 | 9 | 200 | 15.0 |
| 5-4 | L | SP-PW | 42.7 | — | — | — | 0 | — | — | — | 42.7 |
| 5-5 | L | SP-PW | 42.7 | 850 | 820 | 800 | 65 | 14 | 9 | 200 | 15.0 |
| 5-6 | L | SP-PW | 42.7 | 670 | 640 | 600 | 11 | 3 | 1 | 80 | 38.0 |
| 5-7 | M | SP-PW | 42.7 | 700 | 670 | 620 | 41 | 7 | 4 | 140 | 25.3 |
| 5-8 | N | SP | 110 | 700 | 700 | 690 | 69 | 17 | 15 | 400 | 34.1 |
| 5-9 | O | ERW | 42.7 | 720 | 690 | 650 | 65 | 14 | 9 | 200 | 15.0 |
| 5-10 | P | ERW | 110 | 700 | 700 | 680 | 77 | 24 | 18 | 400 | 25.4 |

| | Characteristics of product pipe | | | | | | | |
|---|---|---|---|---|---|---|---|---|
| No. | Tensile strength TS (MPa) | Elongation El (%) | High speed tensile strength (MPa) | Energy absorbed at collision and impact ($MJ \cdot m^{-3}$) | Ferrite grain size ($\mu m$) | Ratio of area of secondary phase (%) | Kind of secondary phase * | Note |
| 5-1 | 530 | 43 | 734 | 242 | 2.0 | 8 | C | Ex. |
| 5-2 | 640 | 38 | 884 | 301 | 1.0 | 7 | C | Ex. |
| 5-3 | 730 | 32 | 931 | 318 | 2.0 | 8 | C | Ex. |
| 5-4 | 470 | 40 | 640 | 196 | 7.0 | 7 | C | C. Ex. |
| 5-5 | 430 | 43 | 592 | 191 | 10.0 | 8 | C | C. Ex. |
| 5-6 | 490 | 37 | 666 | 199 | 6.0 | 8 | C | C. Ex. |
| 5-7 | 530 | 40 | 724 | 240 | 2.5 | 13 | C | Ex. |
| 5-8 | 663 | 42 | 885 | 298 | 1.5 | 23 | C + B | Ex. |

TABLE 8-continued

| | | | | | Rolling conditions | | | | |
|---|---|---|---|---|---|---|---|---|---|
| | 5-9 | 712 | 34 | 931 | 318 | 1.5 | 12 | M | Ex. |
| | 5-10 | 581 | 44 | 802 | 259 | 1.5 | 18 | C | Ex. |

* C: cementite, B: bainite, M: martensite,
Note:
Ex.: examples pertaining to the present invention, C. Ex.: comparative examples.
SP-PW: solid-phase pressure-welded pipe, SP: seamless pipe
ERW: electric resistance welded pipe
* Sample No. 5-4 did not undergo reducing.

TABLE 9

| Steel | Chemical composition (wt %) | | | | | | | | | | |
|---|---|---|---|---|---|---|---|---|---|---|---|
| No. | C | Si | Mn | P | S | Al | N | O | Cu | Ni | Cr |
| Q | 0.05 | 0.30 | 1.22 | 0.007 | 0.001 | 0.022 | 0.0030 | 0.0028 | — | 0.20 | — |
| R | 0.08 | 0.51 | 1.41 | 0.008 | 0.001 | 0.028 | 0.0035 | 0.0019 | 0.12 | 0.18 | 0.15 |
| S | 0.06 | 0.28 | 0.95 | 0.009 | 0.001 | 0.025 | 0.0026 | 0.0025 | — | 0.15 | — |
| T | 0.06 | 0.30 | 1.18 | 0.008 | 0.001 | 0.028 | 0.0031 | 0.0023 | 0.15 | 0.15 | — |
| U | 0.04 | 0.10 | 1.50 | 0.006 | 0.001 | 0.018 | 0.0029 | 0.0023 | — | — | — |

| Steel | Chemical composition (wt %) | | | | | | | $Ac_1$ | |
|---|---|---|---|---|---|---|---|---|---|
| No. | Mo | V | Nb | Ti | B | Ca | REM | (° C.) | Note |
| Q | 0.05 | 0.05 | 0.05 | 0.011 | — | — | — | 770 | Ex. |
| R | — | 0.02 | 0.02 | 0.007 | 0.0011 | — | — | 760 | Ex. |
| S | 0.06 | 0.02 | 0.03 | 0.009 | — | 0.002 | — | 770 | Ex. |
| T | — | 0.04 | 0.03 | 0.009 | — | — | 0007 | 765 | Ex. |
| U | 0.06 | 0.06 | 0.04 | — | — | — | — | 770 | Ex. |

TABLE 10

| | | Base pipe | | Rolling conditions | | | | | | |
|---|---|---|---|---|---|---|---|---|---|---|
| No. | Steel No. | Type | O.D. (mm) | Heating temp. (° C.) | Temp. at starting rolling (° C.) | Temp. at finishing rolling (° C.) | Cumulative diameter reduction (%) | No. of total passes | No. of passes (6% and up per pass) | O.D. of product pipe (mm) |
| 6-1 | Q | ERW | 110 | 720 | 700 | 680 | 45 | 10 | 7 | 60.5 |
| 6-2 | Q | ERW | 110 | 660 | 650 | 640 | 45 | 10 | 7 | 60.5 |
| 6-3 | Q | ERW | 110 | 610 | 600 | 590 | 45 | 10 | 7 | 60.5 |
| 6-4 | Q | ERW | 110 | 880 | 860 | 840 | 45 | 10 | 7 | 60.5 |
| 6-5 | Q | ERW | 110 | 660 | 650 | 640 | 8 | 3 | 7 | 101.6 |
| 6-6 | R | ERW | 110 | 660 | 650 | 640 | 45 | 10 | 1 | 60.5 |
| 6-7 | R | ERW | 110 | 880 | 860 | 830 | 45 | 10 | 7 | 60.5 |
| 6-8 | S | ERW | 110 | 720 | 700 | 690 | 69 | 17 | 15 | 34.1 |
| 6-9 | T | ERW | 110 | 720 | 690 | 650 | 69 | 14 | 15 | 34.1 |
| 6-10 | U | ERW | 110 | 720 | 700 | 680 | 77 | 24 | 18 | 25.4 |

| | Characteristics of product pipe | | | | | | | | | |
|---|---|---|---|---|---|---|---|---|---|---|
| No. | Yield strength (MPa) ** | Tensile strength TS (MPa) | Elongation El (%) | High speed tensile strength (MPa) | Energy absorbed at collision and impact ($MJ \cdot m^{-3}$) | SCC breakage *** | Ferrite grain size ($\mu m$) | Ratio of area of secondary phase (%) | Kind of secondary phase * | Note |
| 6-1 | 507 | 616 | 41 | 786 | 258 | ○ | 2.0 | 5 | C | Ex. |
| 6-2 | 565 | 642 | 38 | 838 | 275 | ○ | 1.5 | 5 | C | Ex. |
| 6-3 | 616 | 692 | 35 | 906 | 293 | ○ | 2.0 | 5 | C | Ex. |
| 6-4 | 460 | 540 | 41 | 705 | 196 | X | 8.0 | 5 | C | C. Ex. |
| 6-5 | 506 | 582 | 43 | 761 | 199 | ○ | 10.0 | 5 | C | C. Ex |
| 6-6 | 637 | 724 | 35 | 943 | 307 | ○ | 2.0 | 20 | C | Ex. |
| 6-7 | 572 | 618 | 40 | 799 | 206 | X X | 6.0 | 26 | M | C. Ex. |
| 6-8 | 560 | 625 | 42 | 815 | 270 | ○ | 1.5 | 5 | C | Ex. |

TABLE 10-continued

| | | | | | | | | | | |
|---|---|---|---|---|---|---|---|---|---|---|
| 6-9 | 582 | 640 | 40 | 830 | 273 | ○ | 1.5 | 5 | C | Ex. |
| 6-10 | 600 | 658 | 38 | 861 | 279 | ○ | 1.5 | 5 | C | Ex. |

Note:
Ex.: examples pertaining to the present invention, C. Ex.: comparative examples.
ERW: electric resistance welded pipe
* C: cementite, B: bainite, M: martensite,
** 0.2% PS
** ○ not broken, X broken

TABLE 11

| Steel | Chemical composition (wt %) | | | | | | | | | | |
|---|---|---|---|---|---|---|---|---|---|---|---|
| No. | C | Si | Mn | P | S | Al | N | O | Cu | Ni | Cr |
| V | 0.09 | 0.02 | 0.73 | 0.011 | 0.003 | 0.032 | 0.0036 | 0.0025 | — | — | — |
| W | 0.11 | 0.15 | 1.28 | 0.007 | 0.001 | 0.028 | 0.0041 | 0.0025 | 0.12 | 0.18 | 0.15 |
| X | 0.14 | 0.35 | 0.91 | 0.008 | 0.001 | 0.025 | 0.0038 | 0.0033 | — | — | — |
| Y | 0.12 | 0.25 | 1.36 | 0.008 | 0.001 | 0.028 | 0.0030 | 0.0028 | — | — | — |
| Z | 0.21 | 0.20 | 0.48 | 0.009 | 0.001 | 0.025 | 0.0038 | 0.0031 | 0.12 | 0.12 | 0.11 |

| Steel | Chemical composition (wt %) | | | | | | | $AC_1$ | |
|---|---|---|---|---|---|---|---|---|---|
| No. | Mo | V | Nb | Ti | B | Ca | REM | (° C.) | Note |
| V | — | — | — | — | — | — | — | 770 | Ex. |
| W | — | — | — | — | — | — | — | 755 | Ex. |
| X | — | 0.02 | 0.021 | 0.007 | 0.0011 | — | — | 770 | Ex. |
| Y | — | — | — | — | — | 0.003 | — | 760 | Ex. |
| Z | 0.05 | 0.02 | 0.009 | 0.009 | — | — | 0.006 | 765 | Ex. |

TABLE 12

| | | | | Rolling conditions | | | | | | |
|---|---|---|---|---|---|---|---|---|---|---|
| | | Base pipe | | Heating | Temp. at starting | Temp. at finishing | Cumulative diameter | No. of | No. of passes (6% and | O.D. of product |
| No. | Steel No. | Type | O.D. (mm) | temp. (° C.) | rolling (° C.) | rolling (° C.) | reduction (%) | total passes | up per pass) | pipe (mm) |
| 7-1 | V | ERW | 110 | 660 | 650 | 630 | 68 | 14 | 9 | 35.0 |
| 7-2 | V | ERW | 35 | — | — | — | — | — | — | 35.0 |
| 7-3 | W | ERW | 110 | 605 | 600 | 590 | 68 | 14 | 9 | 35.0 |
| 7-4 | W | ERW | 110 | 880 | 860 | 830 | 68 | 14 | 9 | 35.0 |
| 7-5 | W | ERW | 110 | 660 | 650 | 640 | 18 | 4 | 2 | 90.0 |
| 7-6 | X | SP | 110 | 660 | 650 | 630 | 77 | 17 | 10 | 25.6 |
| 7-7 | Y | SP | 110 | 660 | 650 | 630 | 77 | 17 | 10 | 25.6 |
| 7-8 | Z | SP | 110 | 660 | 650 | 630 | 77 | 17 | 10 | 25.6 |

| | Characteristics of product pipe | | | | | | | | | |
|---|---|---|---|---|---|---|---|---|---|---|
| No. | Yield strength (MPa) ** | Tensile strength TS (MPa) | Elon-gation El (%) | High speed tensile strength (MPa) | Energy absorbed at collision and impact ($MJ \cdot m^{-3}$) | Fatigue strength (MPa) *** | Ferrite grain size ($\mu m$) | Ratio of area of secondary phase (%) | Kind of sec-ondary phase * | Note |
| 7-1 | 466 | 550 | 47 | 742 | 198 | 220 | 1.5 | 14 | C | Ex. |
| 7-2 | 364 | 448 | 45 | 553 | 124 | 140 | 13.0 | 15 | C | C. Ex. |
| 7-3 | 531 | 612 | 40 | 821 | 223 | 250 | 1.5 | 18 | C | Ex. |
| 7-4 | 421 | 517 | 38 | 648 | 143 | 155 | 8.0 | 16 | C + B | C. Ex. |
| 7-5 | 451 | 522 | 36 | 679 | 151 | 160 | 9.0 | 18 | C | C. Ex. |
| 7-6 | 507 | 596 | 40 | 795 | 196 | 235 | 2.0 | 16 | C | Ex. |

TABLE 12-continued

| | | | | | | | | | | |
|---|---|---|---|---|---|---|---|---|---|---|
| 7-7 | 523 | 618 | 39 | 806 | 198 | 240 | 2.5 | 20 | C | Ex. |
| 7-8 | 570 | 657 | 37 | 850 | 210 | 255 | 2.0 | 23 | C | Ex. |

Note:
Ex: examples pertaining to the present invention, C. Ex.: comparative examples
ERW: electric resistance welded pipe, SP: seamless pipe
* C: cementite, B: bainite, M: martensite,
** 0.2% PS
*** load stress for $10^6$ cycles of endurance.

What is claimed is:

1. A steel pipe having high ductility and high strength which is characterized by an average grain size not greater than 3 μm in the cross section perpendicular to its lengthwise direction and by a structure composed mainly of ferrite or ferrite plus pearlite or ferrite plus cementite, having an elongation of 20% or more produced by working and a tensile strength (TS:MPa) and elongation (EL:%) whose product TS×E1 is 20,000 or more and containing 0.2–1.3 wt % of Mn.

2. A steel pipe having high ductility and high strength as defined in claim 1, which is characterized further by an average grain size not greater than 1 μm in the cross section perpendicular to its lengthwise direction.

3. A steel pipe having high ductility and high strength as defined in claim 1, which is characterized by percent ductile fracture of 95% or more in the cross section perpendicular to its lengthwise direction measured by Charpy impact test on an actual pipe at −100° C.

4. A process for producing a steel pipe having high ductility and high strength, said process comprising heating a steel pipe stock containing not more than 0.60 wt % of carbon and 0.2–1.3 wt % of Mn at a temperature of ($Ac_1$+50° ) to 400° C. and reducing the heated steel pipe stock at a rolling temperature of ($Ac_1$+50° C.) to 400° C. such that the reduction of area is 20% or more.

5. A process for producing a steel pipe as defined in claim 4, wherein said rolling is performed in the presence of a lubricant.

6. A steel pipe having high ductility and high strength which is characterized by a composition of C: 0.005–0.30%, Si: 0.01–3.0%, Mn: 0.2–1.3%, and Al: 0.001–0.10% on a weight basis, with the remainder being Fe and unavoidable impurities, and by a structure of ferrite or ferrite and a secondary phase other than ferrite accounting for not more than 30% of area, said ferrite having a grain size not greater than 3 μm, the steel pipe having an elongation of 20% or more produced by working and a tensile strength (TS:MPa) and elongation (El:%) whose product TSXEl is 20,000 or more.

7. A steel pipe having high ductility and high strength as defined in claim 6, wherein said ferrite has an average grain size not greater than 1 μm.

8. A steel pipe as defined in claim 6, wherein said composition further contains one or more selected from Cu not more than 1%, Ni not more than 2%, Cr not more than 2%, and Mo not more than 1% on a weight basis.

9. A steel pipe as defined in any of claim 6, wherein said composition further contains one or more selected from Nb not more than 0.1%, V not more than 0.3%, Ti not more than 0.2%, and B not more than 0.004% on a weight basis.

10. A steel pipe as defined of claim 6, wherein said composition further contains one or more selected from REM not more than 0.02% and Ca not more than 0.01% on a weight basis.

11. A process for producing a steel pipe having high ductility and high strength, said process comprising heating a steel pipe stock having the composition defined in claim 6 at a temperature of ($Ac_1$+50° C.) to 400° C. and subsequently reducing the heated steel pipe stock at a rolling temperature of ($Ac_1$+50° C.) to 400° C. such that the cumulative reduction of diameter is 20% or more.

12. A process for producing a steel pipe having high ductility and high strength, said process comprising heating a steel pipe stock at a temperature of ($Ac_1$+50° C.) to 400° C. and subsequently reducing the heated steel pipe stock at a rolling temperature of ($Ac_1$+50° C.) to 400° C. such that the cumulative reduction of diameter is greater than 20%, said steel pipe stock having a composition of C: 0.005–0.10%, Si: 0.01–0.5%, Mn: 0.2–1.3%, and Al: 0.001–0.10% on a weight basis, and further one or more selected from Cu not more than 0.5%, Ni not more than 0.6%, Cr not more than 0.5%, and Mo not more than 0.5%, and further one or more selected from Nb not more than 0.1%, V not more than 0.1%, Ti not more than 0.1%, and B not more than 0.004%, and further one or more selected from REM not more than 0.02% and Ca not more than 0.01%, with the remainder being Fe and unavoidable impurities.

13. A process for producing a steel pipe having high ductility and high strength, said process comprising heating a steel pipe stock at a temperature of ($Ac_1$+50° C.) to 400° C. and subsequently reducing the heated steel pipe stock at a rolling temperature of ($Ac_1$+50° C.) to 400° C. such that the cumulative reduction of diameter is 20% or more, said steel pipe stock having a composition of C: 0.06–0.30%, Si: 0.01–1.5%, Mn: 0.2–1.3%, and Al: 0.001–0.10% on a weight basis, with the remainder being Fe and unavoidable impurities.

14. A process for producing a steel pipe as defined in claim 13, wherein said composition further contains one or more selected from Cu not more than 1.0%, Ni not more than 2.0%, Cr not more than 2.0%, and Mo not more than 1.0% on a weight basis.

15. A process for producing a steel pipe as defined in claim 13, wherein said composition further contains one or more selected from Nb not more than 0.1%, V not more than 0.3%, Ti not more than 0.2%, and B not more than 0.004% on a weight basis.

16. A process for producing a steel pipe as defined in claim 13, wherein said composition further contains one or more selected from REM not more than 0.02% and Ca not more than 0.01% on a weight basis.

17. A process for producing a steel pipe as defined in claim 11, wherein the heating temperature is 750–400° C. and the rolling temperature is 750–400° C.

18. A process for producing a steel pipe as defined in claim 11, wherein reducing is performed such that at least one of rolling passes reduces the diameter by 6% or more per pass.

19. A process for producing a steel pipe as defined in claim 11, wherein reducing is performed such that the cumulative reduction of diameter is 60% or more.

20. A process for producing a steel pipe as defined in claim 11, wherein reducing is performed in the presence of a lubricant.

* * * * *